US009915422B2

(12) United States Patent
Haefner et al.

(10) Patent No.: US 9,915,422 B2
(45) Date of Patent: Mar. 13, 2018

(54) COMBUSTION CHAMBER ASSEMBLY UNIT AND METHOD FOR CONSTRUCTION OF A COMBUSTION CHAMBER ASSEMBLY UNIT

(71) Applicant: Eberspächer Climate Control Systems GmbH & Co. KG, Esslingen (DE)

(72) Inventors: Michael Haefner, Stuttgart (DE); Matthias Weese, Korb (DE); Matthias Wagner, Kirchheim (DE); Stephan Krönninger, Waiblingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 350 days.

(21) Appl. No.: 14/840,439

(22) Filed: Aug. 31, 2015

(65) Prior Publication Data

US 2016/0061444 A1 Mar. 3, 2016

(51) Int. Cl.

| | |
|---|---|
| ***F23D 14/46*** | (2006.01) |
| ***F23C 5/02*** | (2006.01) |
| ***F23D 11/36*** | (2006.01) |
| *F24H 9/18* | (2006.01) |

(52) U.S. Cl.

CPC ..... *F23D 14/46* (2013.01); *F23C 5/02* (2013.01); *F23D 11/36* (2013.01); *F23D 2900/21002* (2013.01); *F24H 9/1881* (2013.01)

(58) Field of Classification Search

CPC ..... F23D 14/16; F23D 11/36; F23C 5/02
USPC ..... 431/159; 277/312, 166, 180; 123/294
See application file for complete search history.

(56) References Cited

U.S. PATENT DOCUMENTS

| | | | | |
|---|---|---|---|---|
| 5,145,190 | A | 9/1992 | Boardman | |
| 8,500,131 | B2 * | 8/2013 | Schweiger | F01N 13/1827 277/590 |
| 2009/0285624 | A1 * | 11/2009 | Waddell | F16J 15/061 403/14 |
| 2016/0040784 | A1 * | 2/2016 | Werz | F16J 15/0825 277/595 |

FOREIGN PATENT DOCUMENTS

| | | | |
|---|---|---|---|
| DE | 34 30 278 | A1 | 2/1986 |
| DE | 43 21 514 | A1 | 1/1995 |
| DE | 196 30 973 | A1 | 2/1998 |
| DE | 10 2013 002 046 | B3 | 2/2014 |

* cited by examiner

*Primary Examiner* — Gregory Huson
*Assistant Examiner* — Nikhil Mashruwala
(74) *Attorney, Agent, or Firm* — McGlew and Tuttle, P.C.

(57) ABSTRACT

A combustion chamber assembly unit, especially for a vehicle heater, includes a combustion chamber housing (12) extending in the direction of a combustion chamber housing longitudinal axis (L), a support area (24) extending radially outwards in relation to the combustion chamber housing (12), a sealing element (33) with a first sealing area (34) on a first axial side of the support area (24) and a second sealing area (36) on a second axial side, opposite the first axial side, of the support area (24). A deformation connection area (42) connects the first sealing area (34) and the second sealing area (36) to one another and encloses the support area (24) in a circumferential section that is radially outwards.

12 Claims, 3 Drawing Sheets

COMBUSTION CHAMBER ASSEMBLY UNIT AND METHOD FOR CONSTRUCTION OF A COMBUSTION CHAMBER ASSEMBLY UNIT

CROSS REFERENCE TO RELATED APPLICATIONS

This application claims the benefit of priority under 35 U.S.C. § 119 of German Patent Application 10 2014 217 414.7 filed Sep. 1, 2014, the entire contents of which are incorporated herein by reference.

FIELD OF THE INVENTION

The present invention pertains to a combustion chamber assembly unit, especially for a vehicle heater, comprising a combustion chamber housing extending in the direction of a combustion chamber housing longitudinal axis, a support area extending radially outwards in relation to the combustion chamber housing as well as a sealing element with a first sealing area on a first axial side of the support area and with a second sealing area on a second axial side, opposite the first axial side, of the support area. Further, the present invention pertains to a method, with which a combustion chamber assembly unit can be constructed, for example, with the design described above.

BACKGROUND OF THE INVENTION

DE 10 2013 02 046 B3 discloses a combustion chamber assembly unit for a fuel-operated vehicle heater, in which a flange-like support area extending radially outwards from a combustion chamber housing is held between a first outer housing and a second outer housing. In this connection, the first outer housing is, for example, associated with a combustion air guide blower, while the second outer housing may be associated, for example, with a heat exchanger arrangement. In order to be able to obtain a fluid-tight connection of the flange-like support area in relation to the first outer housing and in relation to the second outer housing, a sealing element with a U-shaped cross section made of flexible material, e.g., silicone, extending entirely around the radial outer area of the support area, is provided. This flexible sealing element with U-shaped cross section can be pulled from the outside over the entire circumferential area of the support area because of its elasticity and its stretchability, such that in the assembled state, it extends continuously over the entire circumferential area, enclosing the support area radially outwards and overlapping radially inwards on both axial sides in some sections.

SUMMARY OF THE INVENTION

An object of the present invention is to provide a combustion chamber assembly unit, in which a reliable sealing of a support area of a combustion chamber housing in relation to the assembly units interacting with same in a supportive manner can be achieved with a simple construction. Further, an object of the present invention is to provide a method for the construction of such a combustion chamber assembly unit.

According to a first aspect a combustion chamber assembly unit, especially for a vehicle heater, comprising a combustion chamber housing extending in the direction of a combustion chamber housing longitudinal axis, a support area extending radially outwards in relation to the combustion chamber housing, a sealing element with a first sealing area on a first axial side of the support area and with a second sealing area on a second axial side, opposite the first axial side, of the support area.

According to the present invention, this combustion chamber assembly unit is characterized by a deformation connection area connecting the first sealing area and the second sealing area to one another and enclosing the support area in a circumferential section radially outwards.

In the construction according to the present invention, a sealing element constructed integrally with the two sealing areas and the deformation connection area can be utilized, with which, on the one hand, because of the integral connection of the two sealing areas, it is guaranteed that a sealing area is forcibly positioned on both axial sides of the support area during the assembly of a heater, for example, of a fuel-operated vehicle heater. Moreover, since the deformation connection area is provided such that it overlaps the support area only in one circumferential section radially outwards, this overlap or the enclosing of the support area on its radial outer area is also only limited to one circumferential section. Such an overlap is not present in other circumferential sections, such that a mutual interference of the sealing element with system areas of a heater interacting with the support area can be avoided there. At the same time, it is possible to form the sealing element in a simple manner, for example, from a plate-like blank, and to bring it into the desired shape for establishing the sealing state by means of deformation of the deformation connection area.

To be able to bring the sealing element into a position permitting the necessary sealing interaction with the support area in relation to the combustion chamber housing, on the one hand, and to be able to also achieve a reliable sealing of the assembly units to be sealed against one another, on the other hand, it is suggested that a combustion chamber housing opening be provided in the first sealing area or/and in the second sealing area for the accommodation of the combustion chamber housing, and that a sealing surface extending entirely around the combustion chamber housing opening be provided on a first side of the sealing element or/and on a second side of the sealing element in the first sealing area or/and in the second sealing area.

To be able to make possible the overlap of the sealing element provided radially outwards with its deformation connection area about the support area in a simple manner, but at the same time also to be able to guarantee the necessary radial and circumferential positioning of the sealing element with its two sealing areas in relation to the combustion chamber housing, it is suggested that the deformation connection area comprise a first connecting leg extending radially outwards from the first sealing area, a second connecting leg extending radially outwards from the second sealing area and a deformation section connecting the first connecting leg and the second connecting leg to one another.

In an especially advantageous embodiment variant, provisions may be made for the deformation connection section to comprise a deformation section with at least one deformation web, and preferably at least two deformation webs and with an opening between at least two deformation webs. Especially if the deformation section is designed with a plurality of deformation webs and with an opening each between them, the material or volume area of the sealing element to be deformed for forming the sealing element in one piece with the support area is minimized. The result of this is that a compromise of sealing material provided at the sealing element is avoided during the deformation of sealing element for the most part.

In the construction according to the present invention, provisions may be further made for at least one mounting opening to be provided in the support area, for a first passage opening to be provided in the first sealing area in association with at least one mounting opening or/and for a second passage opening to be provided in the second sealing area in association with at least one mounting opening, and for the deformation section to have a radial distance to the support area with the mounting and passage openings aligned with one another. By providing the radial distance of the deformation section to the support area with correct positioning of the sealing element in relation to the combustion chamber housing, it is guaranteed that first this sealing element can be displaced, for example, radially in relation to the combustion chamber housing for deforming the sealing element and after the deformation has been carried out, is moved so far in the radial direction or in the circumferential direction that the exact positioning is achieved for ensuring a necessary sealing functionality.

The sealing element can be constructed with a core material area, which is preferably made of metallic material, in its first sealing area, its second sealing area and its deformation connection area. On a first side or/and on a second side of the sealing element, sealing material, preferably graphite material, can be provided on the core material area. In this connection, the construction of the core material area with steel plate, which is covered on the first side or/and on the second side with a preferably film-like layer of graphite, is especially advantageous. A sealing element constructed in this manner can be formed, for example, from a plate-like sealing element blank by punching out or other separation steps.

According to another aspect, the object mentioned in the introduction is accomplished by a method for the construction of a combustion chamber assembly unit, preferably with the construction described above, comprising the steps:

a) Providing a combustion chamber housing extending along a combustion chamber housing longitudinal axis and a support area extending radially outwards in relation to the combustion chamber housing, b) Providing a sealing element with a first sealing area, a second sealing area and a deformation connection area connecting the first sealing area to the second sealing area, wherein the sealing element in the first sealing area and in the second sealing area has a combustion chamber housing opening for the accommodation of the combustion chamber housing, c) Pushing the sealing element with a sealing area onto the combustion chamber housing from a first axial side in relation to the support area in such a way that the combustion chamber housing is arranged in the combustion chamber housing opening of this sealing area and this sealing area is positioned in the area of an axial side of the support area, and d) Deformation of the sealing element in the deformation connection area and pushing of the other sealing area onto the combustion chamber housing, on the other axial side in relation to the support area, in such a way that the combustion chamber housing is arranged in the combustion chamber housing opening of the other sealing area and the other sealing area is positioned in the area of the other axial side of the support area.

To be able to push the other sealing area onto the combustion chamber housing especially when carrying out step d) and thereby to be able to accommodate the combustion chamber housing in the combustion chamber housing opening of this other sealing area, the sealing area already pushed over the combustion chamber housing must be moved out of the installation position actually provided for it at least slightly in the radial direction, and possibly also in the circumferential direction. To compensate this, provisions may further be made for a step e) to be carried out after step d) for moving the sealing element in the radial direction or/and in the circumferential direction in relation to the support area in such a way that at least one mounting opening provided in the support area is aligned with a passage opening provided in the first sealing area or/and a passage opening provided in the second sealing area.

In the method according to the present invention, in the construction of the combustion chamber assembly unit or in the integration of same into a, for example, fuel-operated vehicle heater, provisions may further be made for, after step d), preferably after step e), the support area to be arranged between a first outer housing and a second outer housing in such a way that first sealing surfaces provided on the first sealing area and on the second sealing area are in contact with an axial side of the support area and second sealing surfaces provided on the first sealing area and on the second sealing area are in contact with the first outer housing and with the second outer housing.

To be able to provide the sealing element in an especially simple and cost-effective manner in the method according to the present invention, it is suggested that step b) comprise separating out, preferably punching out, the sealing element from a plate-like sealing element blank, wherein preferably the sealing element blank comprises a core material area and sealing material on at least one, and preferably both sides.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
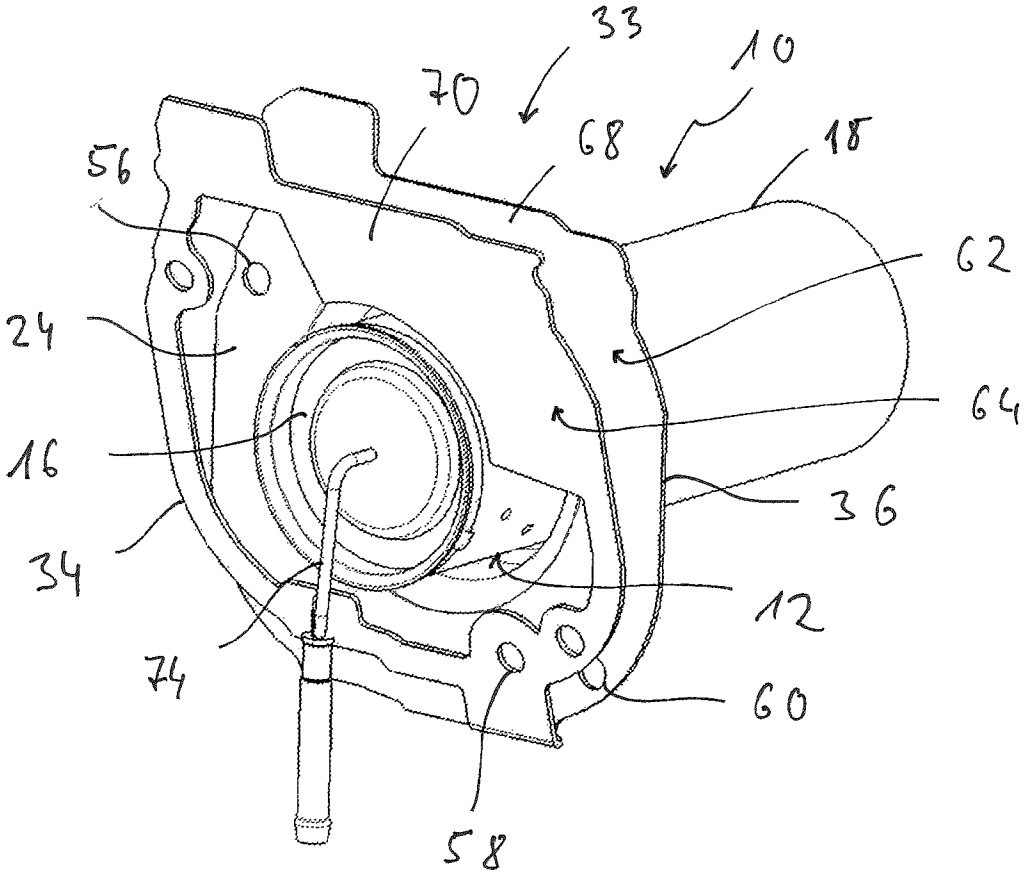
FIG. 1 is a perspective view of a combustion chamber assembly unit with a sealing element for sealing a support area of the combustion chamber assembly unit.

Referring to the drawings, a combustion chamber assembly unit which can be used, for example, in a fuel-operated heater, is generally designated with 10 in the Figures. The combustion chamber assembly unit 10 comprises a combustion chamber housing 12, which may define a combustion chamber which cannot be seen in the figures and can be constructed, for example, with a circumferential wall 14 and a bottom wall 16. An exhaust pipe 18, via which the combustion waste gases forming during combustion in the combustion chamber can come out, may be provided adjacent to the circumferential wall 14 or formed integrally with same. The combustion chamber housing 12 has, e.g., an essentially cylindrical structure and is designed as extending in the direction of a combustion chamber housing longitudinal axis L.

A support element generally designated with 20 is fixed to the circumferential wall 14 or to the exhaust pipe 18. In the example shown, the support element 20 has a connection area 22 connected to the outer circumference of the exhaust pipe 18, enclosing the exhaust pipe 18 and extending in some areas also in the direction of the combustion chamber housing longitudinal axis L, as well as a support area 24 with a ring-like or ring-washer-like, i.e., flange-like design extending radially outwards from the connection area 22. Just as the circumferential wall 14 or the exhaust pipe 18, the support element 20 may be constructed of sheet metal material.

With its support area 24 extending entirely in the circumferential direction around the combustion chamber housing longitudinal axis L or the combustion chamber housing 12, the support element 20 and with this element the combustion chamber housing 12 can be fixed to other system areas of a vehicle heater. A first outer housing 26 and a second outer housing 28 connecting to same in the direction of the combustion chamber housing longitudinal axis L with interpositioning of the support area 24 are shown as an example in some sections in FIG. 2. In this connection, the first outer housing 26 may be associated, for example, with a combustion air blower and define a combustion air flow chamber 30 enclosing the combustion chamber housing 12 in some areas. The second outer housing 28 may be associated, for example, with a heat exchanger arrangement, which, on the one hand, defines a heat exchanger medium flow chamber for heat exchanger medium to be heated and, on the other hand, defines a combustion waste gas flow chamber 32, in which the combustion waste gases coming out of the exhaust pipe 18 flow to a waste gas outlet. The two outer housings 26, 28 are designed in such a way that they are able to accommodate the support area 24 between them over the entire circumferential area about the combustion chamber housing longitudinal axis L and thus are able to bring about a separation of the combustion air flow chamber 30 from the waste gas flow chamber 32 over the entire circumference.

Figure 2:
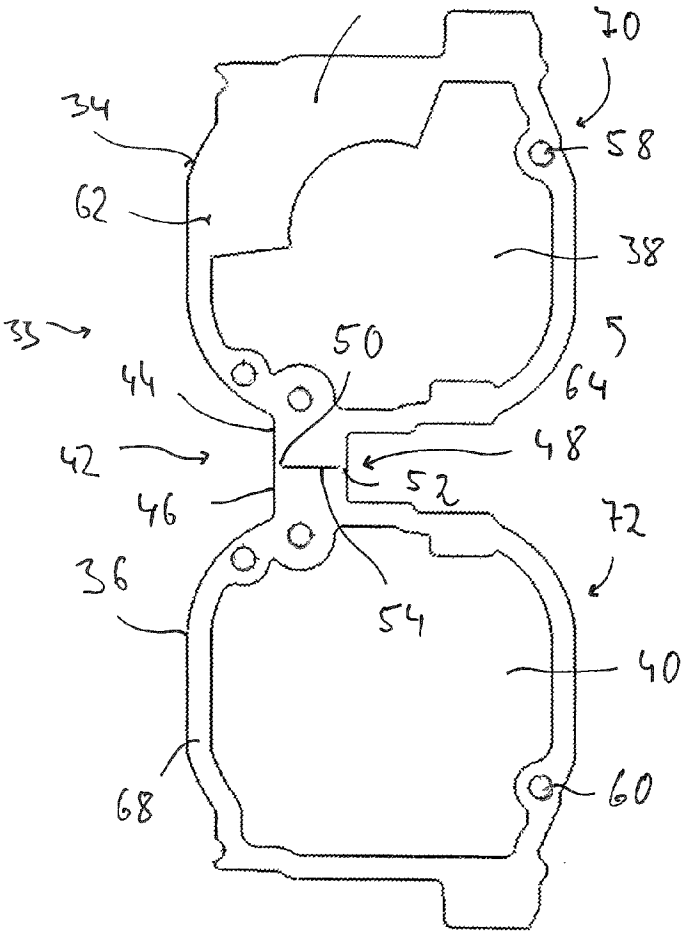
FIG. 2 is a top view of a sealing element of the combustion chamber assembly unit of FIG. 1.
Figure 5:
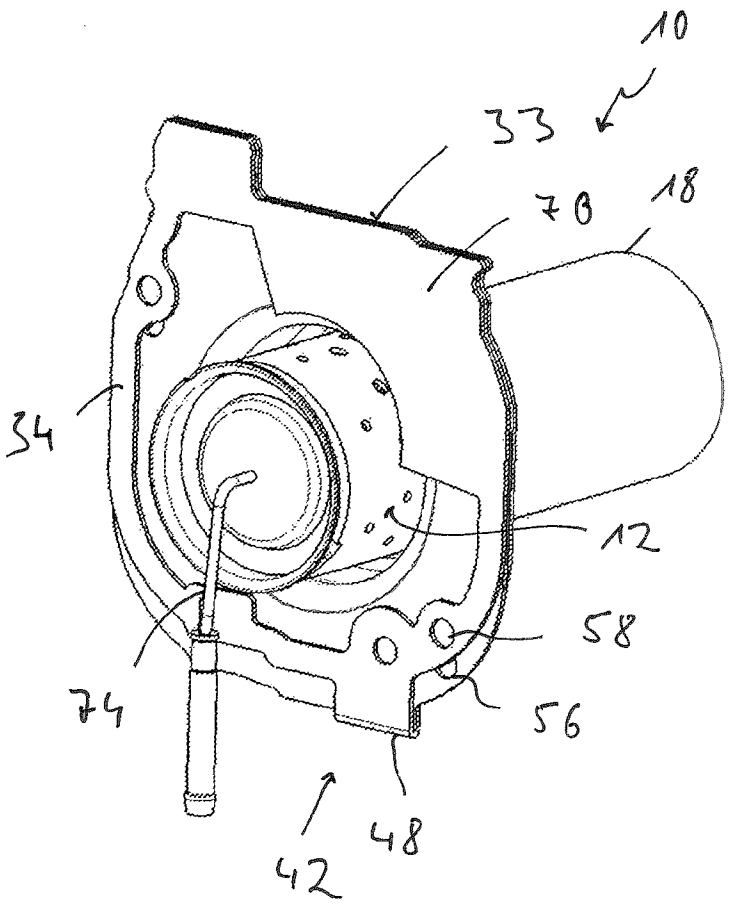
FIG. 5 is a perspective view corresponding to FIG. 4 with the sealing element displaced out of the mounting opening.

To be able to form the connection of the support area 24 to the two outer housings 26 in a fluid-tight manner, a sealing element 33 also shown in FIG. 2 is provided. This sealing element 33 comprises a first sealing area 34 and a second sealing area 36, which, in the assembled state, are positioned on the two axial sides of the support area 24. The two sealing areas 34, 36 have each a combustion chamber housing opening 38 and 40, respectively, in which the combustion chamber housing 12 is accommodated or extends. Each of the sealing areas 34, 36 provides a ring-like, closed circumferential structure.

The two sealing areas 34, 36 are connected to one another in a deformation connection area 42. In the example shown, the deformation connection area 42 comprises a first connecting leg 44 extending starting from the first sealing area 34 and a second connecting leg 46 starting from the second sealing area 36. The two connecting legs 44, 46 are connected to one another in a deformation section 48. For this purpose, the deformation area 48 may comprise two deformation webs 50, 52, between which is located an opening 54 with a, for example, slot-like design. The two deformation webs 50, 52 are bent by folding the two sealing areas 34, 36 over one another. Because of providing the opening 54, this bending can take place with relatively low expenditure of force and the volume area to be deformed is actually limited to the two deformation webs 50, 52.

In association with mounting openings 56 of the support area 24, the first sealing area 34 and the second sealing area 36 have respective first passage openings 58 and second passage openings 60. If the two sealing areas 34, 36 are positioned on the two axial sides of the support area 24, the sealing element 33 can be positioned such that the passage openings 58, 60 are aligned with the mounting openings 56 and the two outer housings 26, 28 can be fastened to one another, for example, by means of using bolts or the like with interpositioning of the support area 24 and the two sealing areas 34, 36 of the sealing element 33.

The sealing element 33 is preferably constructed with a core material area made of steel plate. On the first side 62 lying at the top, visible in FIG. 2, as well as on the side 64 lying at the bottom in FIG. 2 of the sealing element 33, respective layers of sealing material, preferably graphite material, which may have a film-like design and may be applied to the core material area in the form of a film, are provided on the core material area. The sealing element 33 can thus be separated from a sealing element blank by punching out or other separation steps, wherein the sealing element blank may be already constructed with the core material area and the sealing material on both sides of same. During the separation of the sealing element 30, the passage openings 58, 60 as well as the slot-like opening 54 provided between the two deformation webs 50, 52 may also be generated. This slot-like opening 54 may be generated by inserting a notch, which does not necessarily have to pass through the entire core material area. The slot-like opening 54 may also be generated only by partially impressing the core material area by breaking open the core material area during the subsequent deformation of the deformation connection area 42 where this impression is formed. However, for providing a defined deformation behavior, the slot-like opening 54 is advantageously completely inserted through the material of the sealing element 33.

Each of the two sealing areas 34, 36 has a respective first sealing surface 66 and 68 extending entirely around the respective combustion chamber housing opening 38 and 40 on the first side 62 of the sealing element 33 as well as a respective second sealing surface 70 and 72 on the second side 64. If the sealing element 33 is folded, for example, as shown in FIG. 1, such that the first sealing surfaces 66, 68 provided on the first side 62 lie facing one another, the second sealing surfaces 70, 72 formed on the second side 64 lie facing away from one another. The support area 24 of the support element 20 is thus accommodated between the two first sealing surfaces 66, 68 of the sealing areas 34, 36, such that these first sealing surfaces 66, 68 are in contact with the support area 24, while the second sealing surfaces 70, 72 lying outwards, i.e., oriented axially away from one another, lie between the two outer housings 26, 28 or in contact with same. The two first sealing surfaces 66, 68 thus have a sealing effect towards the support area 24, while the two second sealing surfaces 70, 72 have a sealing effect towards the first outer housing 26 or towards the second outer housing 28.

Figure 3:
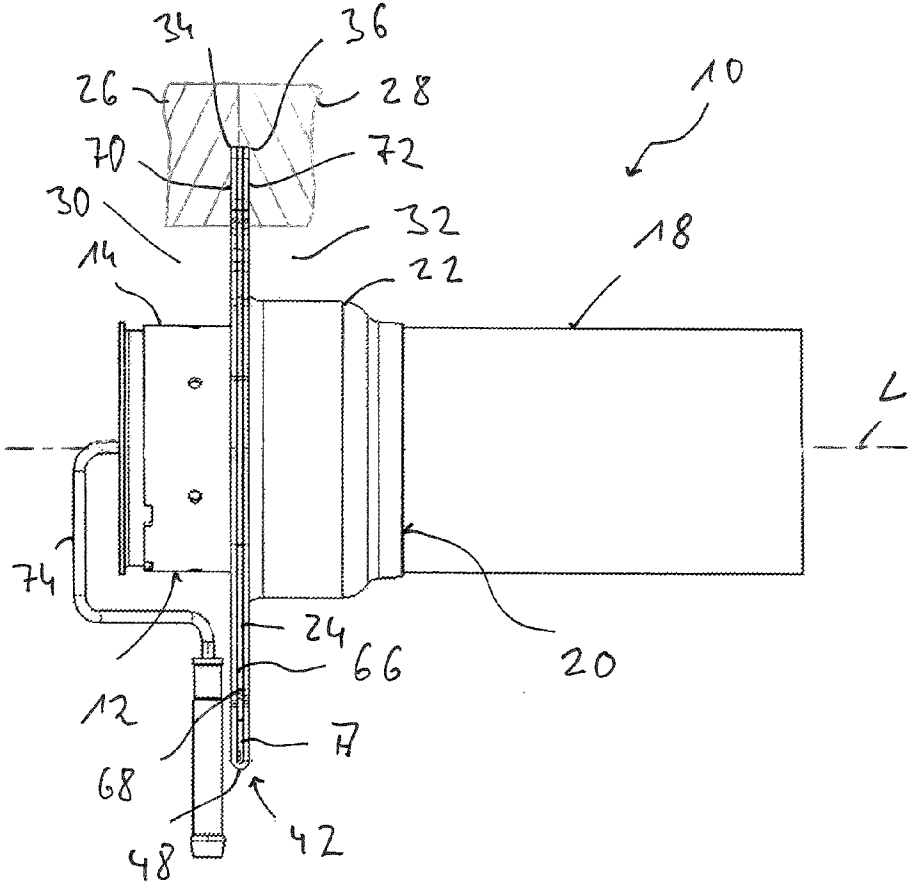
FIG. 3 is a side view showing of the combustion chamber assembly unit of FIG. 1.
Figure 4:
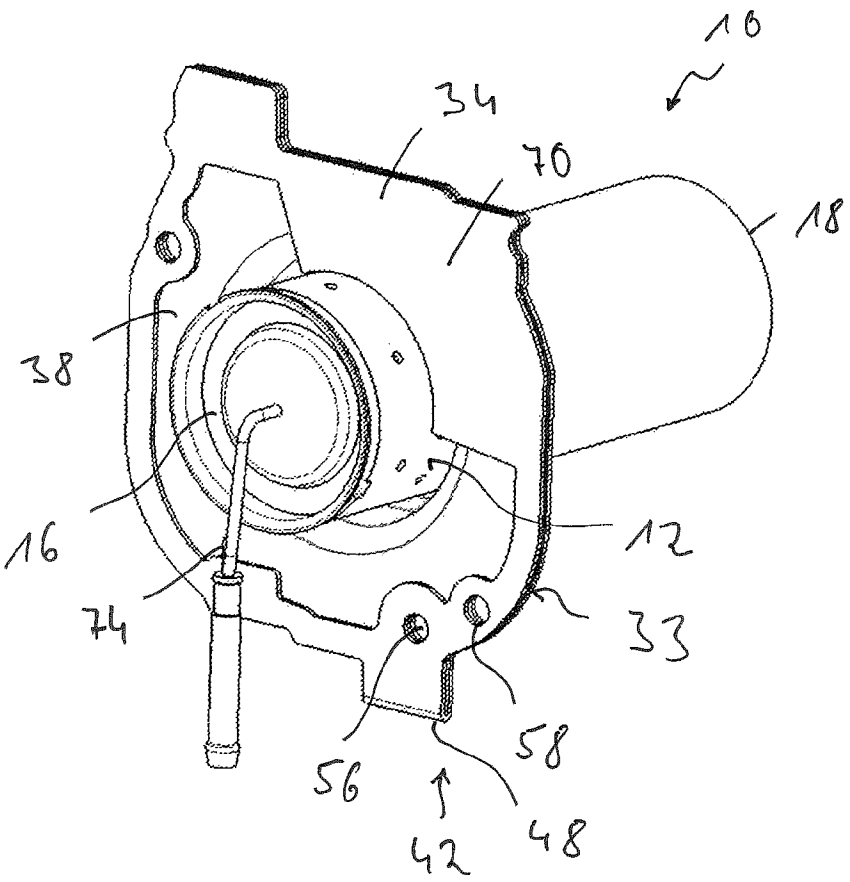
FIG. 4 is a perspective view showing the combustion chamber assembly unit of FIG. 1 with sealing element arranged in a mounting positioning.

Further, it is seen in FIG. 3 that, in the installed state, i.e., with passage openings and mounting openings 58, 60, 56 aligned with one another, the deformation section 48 of the deformation connection area 42 has a distance A to the radial outer edge area of the support area 24 in this section enclosed by the deformation connection area 42 on the outside. This relative positioning of the sealing element 33 to the support area 24 is also shown in FIG. 4. Because of the presence of the distance A, the sealing element 33 can be displaced from this position in each radial direction in relation to the support area 24, which is especially advantageous during the joining together of the sealing element 33 with the combustion chamber housing 12.

In the construction of the combustion chamber assembly unit 10 described in detail above, after the combustion chamber housing 12 with the support element 20 and the sealing element 33 first provided in plane form were produced, the sealing element 33 will be pushed, for example, with its second sealing area 36 over the combustion chamber housing 12. In the view of FIG. 3, the sealing area 36 on the axial side lying towards the exhaust pipe 18 in relation to the support area 24 is pushed onto the combustion chamber housing 12 or the exhaust pipe 18 of same. In this connection, the sealing area 36 is brought forward to the support area 24, for example, until the first sealing surface 68 of same is in contact with the axial side of the support area 24 facing the exhaust pipe 18. The sealing element is then bent in its deformation connection area 42, such that the first sealing area 34 on the other axial side in relation to the support area 24 is moved over the combustion chamber housing 12, i.e., this element enters the combustion chamber housing opening 38 of the first sealing area 34. In order to be able to carry out this process, it is advantageous to displace the sealing element 33 radially so far in relation to the combustion chamber housing 12 that the first sealing area 34 can be guided over the section of the combustion chamber housing lying on the left side in FIG. 3 in relation to the support area 24, especially over a line section 74 of a fuel feed line connected in this area to the combustion chamber housing 12. The first sealing area 34 is then moved in the direction towards the support area 24 until its first sealing surface 66 is in contact with the support element 24 and thus this support element is accommodated between the two sealing areas 34, 36 in a sandwich-like manner. Subsequently, the sealing element 33 can then be displaced in the radial direction or even in the circumferential direction until the passage openings 58, 60 of the two sealing areas 34, 36 are aligned with the mounting openings 56 in the support area 24.

In a subsequent mounting step, the two outer housings 26, 28 can be moved toward the combustion chamber housing 12 or the support area 24 of same enclosed by the sealing element 33, such that the configuration which can be seen in FIG. 3 is obtained, in which the sandwich-like arrangement of the two sealing areas 34, 36 and of the support area 24 positioned between them are accommodated or can also be clamped between the two outer housings 26, 28. Then, fastening elements, for example, bolts, can be inserted in order to obtain a rigid connection.

In the construction of a combustion chamber assembly unit according to the present invention with the sealing element manufactured from flat material and to be folded for providing a reliable sealing action in relation to the two outer housings, a reliable sealing action is achieved with a simple construction. Because of the integral design of the sealing element with its two sealing areas and the deformation connection area connecting same, it is ensured that a sealing element is always positioned on both sides of the support area. Since a deformation takes place in the deformation connection area only in comparatively small volume areas, namely the deformation webs of same, the risk that damage to the sealing material applied to the core material area on both sides of the sealing element is minimized. This means that the sealing element 33 can be separated from a sealing element blank in an efficient manner in terms of material consumption, since this blank can be constructed with a core material area having a plate-like design, which can be continuously coated on its two sides with the sealing material.

While specific embodiments of the invention have been shown and described in detail to illustrate the application of the principles of the invention, it will be understood that the invention may be embodied otherwise without departing from such principles.

What is claimed is:

1. A combustion chamber assembly unit comprising:

a combustion chamber housing extending in the direction of a combustion chamber housing longitudinal axis;

a support area extending radially outwards in relation to the combustion chamber housing;

a sealing element comprising a first sealing area on a first axial side of the support area and a second sealing area on a second axial side, opposite the first axial side, of the support area; and a deformation connection area connecting the first sealing area and the second sealing area to one another and enclosing the support area in a radially outward circumferential section, wherein the deformation connection area comprises a first connecting leg extending radially outwards from the first sealing area, a second connecting leg extending radially outwards from the second sealing area and a deformation section connecting the first connecting leg and the second connecting leg to one another.

2. A combustion chamber assembly unit in accordance with claim 1, wherein:

a combustion chamber housing opening is provided at least one of in the first sealing area and in the second sealing area, the combustion chamber housing opening for accommodating the combustion chamber housing; and a sealing surface, entirely extending around the combustion chamber housing opening, is provided at least one of on a first side of the sealing element and on a second side of the sealing element at least one of in the first sealing area and in the second sealing area.

3. A combustion chamber assembly unit in accordance with claim 1, wherein:

at least one mounting opening is provided in the support area;

a passage opening is provided at least one of in the first sealing area in association with the at least one mounting opening and in the second sealing area in association with the at least one mounting opening; and with the mounting and passage openings aligned with one another, the deformation section has a defined radial distance to the support area.

4. A combustion chamber assembly unit in accordance with claim 1, wherein the deformation connection area comprises a deformation section with at least two deformation webs and an opening between the at least two deformation webs.

5. A combustion chamber assembly unit in accordance with claim 4, wherein:

at least one mounting opening is provided in the support area;

a passage opening is provided at least one of in the first sealing area in association with the at least one mounting opening and in the second sealing area in association with the at least one mounting opening; and with the mounting and passage openings aligned with one another, the deformation section has a defined radial distance to the support area.

6. A combustion chamber assembly unit in accordance with claim 1, wherein the sealing element in the first sealing area, in the second sealing area and in the deformation connection area comprises a core material area, of metallic material, and sealing graphite material, at least one of on a first side and on a second side.

7. A combustion chamber assembly unit in accordance with claim 6, wherein at least one of:

the core material area is constructed with steel plate; and the sealing material at least one of on the first side and on the second side of the sealing element comprises a film layer of graphite.

8. A method for the construction of a combustion chamber assembly unit, the method comprising the steps of:

providing a combustion chamber housing extending along a combustion chamber housing longitudinal axis;

providing a support area extending radially outwards in relation to the combustion chamber housing;

providing a sealing element with a first sealing area, a second sealing area and a deformation connection area connecting the first sealing area to the second sealing area;

providing the sealing element in the first sealing area and in the second sealing area with a combustion chamber housing opening for the accommodation of the combustion chamber housing;

pushing the sealing element with the first sealing area onto the combustion chamber housing from a first axial side in relation to the support area in such a way that the combustion chamber housing is arranged in the combustion chamber housing opening of the first sealing area and the first sealing area is positioned in the area of an axial side of the support area; and deforming the sealing element in the deformation connection area and pushing the second sealing area onto the combustion chamber housing on a second axial side in relation to the support area in such a way that the combustion chamber housing is arranged in the combustion chamber housing opening of the second sealing area and the first sealing area is positioned in the area of the other axial side of the support area.

9. A method in accordance with claim 8, further comprising the steps of:

providing a mounting opening in the support area;

providing a passage opening at least one of in the first sealing area and in the second sealing area; and following the step of deforming the sealing element, moving the sealing element at least one of in a radial direction and in a circumferential direction in relation to the support area in such a way that the mounting opening is aligned with the passage opening.

10. A method in accordance with claim 9, further comprising the steps of:

providing a first outer housing;

providing a second outer housing; and following the step of moving the sealing element, arranging the support area between the first outer housing and the second outer housing such that first sealing surfaces, provided on the first sealing area and second sealing area, are in contact with an axial side of the support area and second sealing surfaces, provided on the first sealing area and on the second sealing area, are in contact with the first outer housing and with the second outer housing.

11. A method in accordance with claim 8, further comprising the steps of:

providing a first outer housing;

providing a second outer housing; and following the step of deforming the sealing element, arranging the support area between the first outer housing and the second outer housing such that first sealing surfaces, provided on the first sealing area and second sealing area, are in contact with an axial side of the support area and second sealing surfaces, provided on the first sealing area and on the second sealing area, are in contact with the first outer housing and with the second outer housing.

12. A method in accordance with claim 8, wherein the step of providing a sealing element comprises punching out the sealing element from a sealing element blank, wherein the sealing element blank comprises a core material area and sealing material on at least one side.

* * * * *